US007417562B2

(12) United States Patent
Sera

(10) Patent No.: US 7,417,562 B2
(45) Date of Patent: Aug. 26, 2008

(54) TRAFFIC INFORMATION DISPLAY DEVICE, TRAFFIC INFORMATION DISPLAY METHOD, AND ON-VEHICLE ELECTRONIC APPARATUS

(75) Inventor: Manabu Sera, Chigasaki (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 156 days.

(21) Appl. No.: 11/389,154

(22) Filed: Mar. 27, 2006

(65) Prior Publication Data

US 2006/0220924 A1 Oct. 5, 2006

(30) Foreign Application Priority Data

Mar. 28, 2005 (JP) ..... 2005-090946

(51) Int. Cl.
*G08G 1/123* (2006.01)

(52) U.S. Cl. ..... 340/995.13; 340/995.24; 340/995.27; 701/211

(58) Field of Classification Search ..... 340/995.12, 340/905, 995.13, 995.24, 995.27; 701/207, 701/208, 211, 213
See application file for complete search history.

(56) References Cited

U.S. PATENT DOCUMENTS

| | | | | |
|---|---|---|---|---|
| 4,409,583 | A * | 10/1983 | Dahan et al. | 340/995.13 |
| 5,831,552 | A * | 11/1998 | Sogawa et al. | 340/995.27 |
| 6,138,072 | A * | 10/2000 | Nagai | 701/207 |
| 6,922,629 | B2 * | 7/2005 | Yoshikawa et al. | 701/117 |
| 2002/0032519 | A1 * | 3/2002 | Mochizuki et al. | 701/208 |
| 2003/0225516 | A1 * | 12/2003 | DeKock et al. | 701/214 |
| 2004/0220727 | A1 * | 11/2004 | Adachi | 701/208 |

FOREIGN PATENT DOCUMENTS

JP 2001-208557 A 8/2001

* cited by examiner

*Primary Examiner*—Brent Swarthout
(74) *Attorney, Agent, or Firm*—Foley & Lardner LLP

(57) ABSTRACT

Along with displaying on a map a sign which indicates the type of a traffic event at the side of the traffic lane upon which the traffic event has occurred, the sign and the position of the traffic event are displayed upon the map in a state of being connected together by a line or by a drawing.

14 Claims, 5 Drawing Sheets

TRAFFIC INFORMATION DISPLAY DEVICE, TRAFFIC INFORMATION DISPLAY METHOD, AND ON-VEHICLE ELECTRONIC APPARATUS

BACKGROUND OF THE INVENTION

1. Field of the Invention

The present invention relates to a device and a method for displaying road traffic information.

2. Description of Related Art

A road traffic information display device is known which, in order to classify road traffic information into information related to the flow of traffic upon a lane in one direction along a road and information related to the flow of traffic upon a lane in the other direction along the road, displays the road traffic information upon a screen by displacing it to the right side or to the left side from the center of the road (for example, refer to Japanese Patent Laid-Open Publication 2001-208557).

SUMMARY OF THE INVENTION

However, since with the above described prior art traffic information display device the gap between one road and another becomes narrow when displaying a wide area map by reducing the scale of the map, accordingly there is a possibility that, when displaying traffic information, the traffic information for adjacent roads will become confused.

It would be desirable to provide a traffic information display device that comprises a monitor that displays on a map a sign which indicates the type of a traffic event at the side of the traffic lane upon which the traffic event is occurring. The sign is connected to the position of the traffic event on the map.

Also it would be desirable to provide an on-vehicle electronic apparatus that comprises a receiver that receives traffic information and the traffic information display device described above.

Moreover, it would be desirable to provide a traffic information display method that comprises displaying on a map a sign which indicates the type of a traffic event at the side of the road of the traffic lane upon which the traffic event is occurring. The sign is connected to the position of the traffic event on the map.

DETAILED DESCRIPTION OF THE PREFERRED EMBODIMENTS

Figure 1:
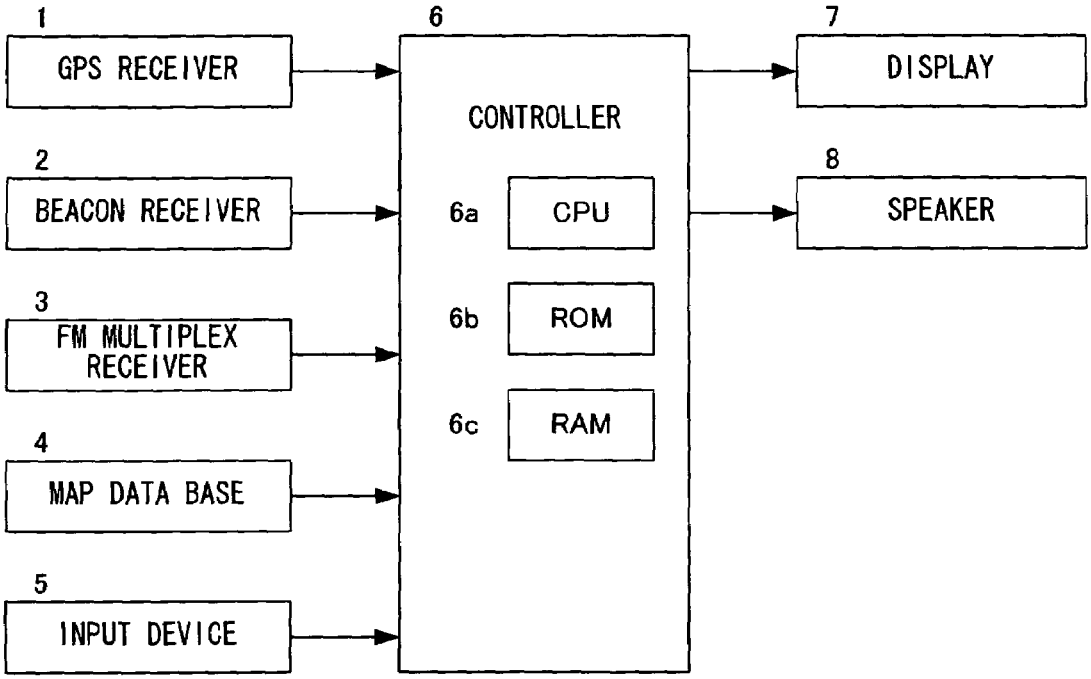
FIG. 1 is a block diagram showing the overall structure of the preferred embodiment of the traffic information display device of the present invention.

In the following, an example in which the traffic information display device according to the preferred embodiment is applied to a navigation device will be explained. FIG. 1 is a block diagram showing the overall structure in the preferred embodiment of the traffic information display device. The traffic information display device in the embodiment comprises a GPS receiver 1, a beacon receiver 2, an FM multiplex receiver 3, a map data base 4, an input device 5, a controller 6, a display 7, and a speaker 8.

The GPS receiver 1 detects the current position of the vehicle by satellite navigation. The beacon receiver receives optical beacon broadcasts and radio beacon broadcasts which are transmitted from roadside beacons. The FM multiplex receiver 3 receives FM multiplexed broadcasts which are transmitted from FM broadcasting stations. Road traffic information such as traffic congestion, traffic controls and the like is included in these optical beacon broadcasts, radio beacon broadcasts and FM multiplexed broadcasts.

Road map data is stored in the map data base 4. The input device 5 is a set of actuation switches such as push-button switches, direction keys and the like. Using this input device 5, the user is able to perform various operations such as setting a destination, scrolling the map, changing the scale of the map and so on.

The controller 6 comprises a CPU 6*a*, a ROM 6*b*, a RAM 6*c* and the like, and performs navigation control such as guidance along a path to the destination and soon, and display control of a road map. Upon the display 7, along with the road map, there are also displayed the current position of the vehicle, traffic information and the like. Path guidance notifications, traffic information notifications and so on are outputted from the speaker 8.

Figure 2:
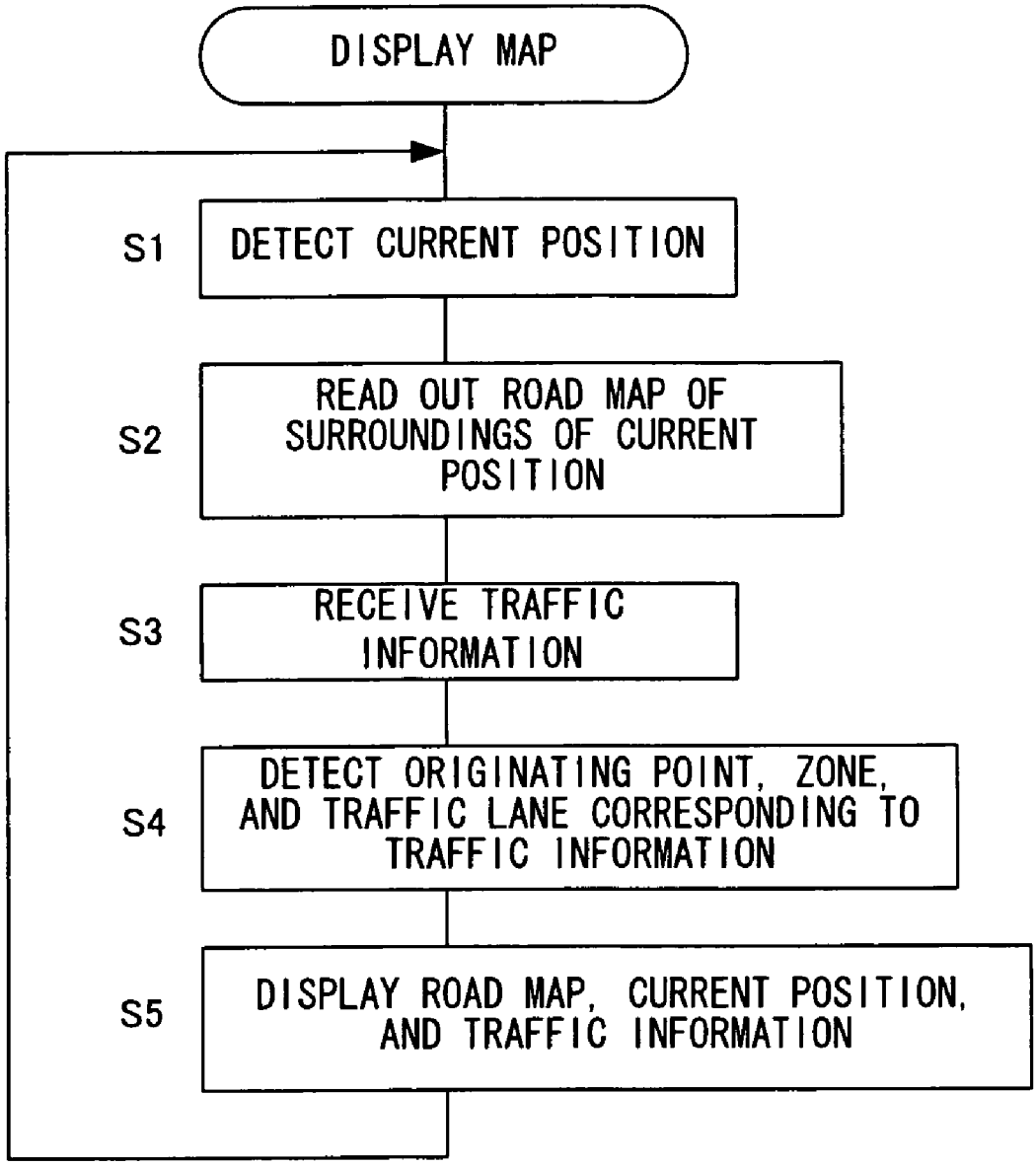
FIG. 2 is a flow chart showing a map display program of this embodiment.

FIG. 2 is a flow chart showing the details of a map display program which is executed by the traffic information display device according to the preferred embodiment. The controller 6 repeatedly executes this map display program.

In a step S1, the current position of the vehicle detected by the GPS receiver 1 is acquired, and then the flow of control proceeds to the step S2. In the step S2, based upon the current vehicle position which has been acquired in the step S1, a road map including the current vehicle position is read out from the map data base 4.

In a step S3 following the step S2, traffic information which is received by the beacon receiver 2 and by the FM multiplex receiver 3 is acquired, and then the flow of control proceeds to a step S4. In the step S4, the originating point of the traffic event, the zone which corresponds to the traffic event, and the corresponding traffic lane are detected based on the traffic information, and then the flow of control proceeds to the step S5.

In the step S5, along with displaying a road map of the surroundings of the current vehicle position on the display 7, the current position of the vehicle and the traffic information are displayed upon the map. When displaying the traffic information, the display is made very clearly so that the user may be able to recognize the originating point of the traffic event, the zone which corresponds to the traffic event and the corresponding traffic lane.

Next, a display method for the traffic information will be explained by citing, by way of example, a case in which a restriction has occurred upon the road due to a vehicle breakdown or the like. Although, in the following, the case will be explained in which north upon the map is displayed towards the top of the display screen, the display method would be the same if the direction of progression of the vehicle were to be displayed towards the top of the display screen.

Figure 3:
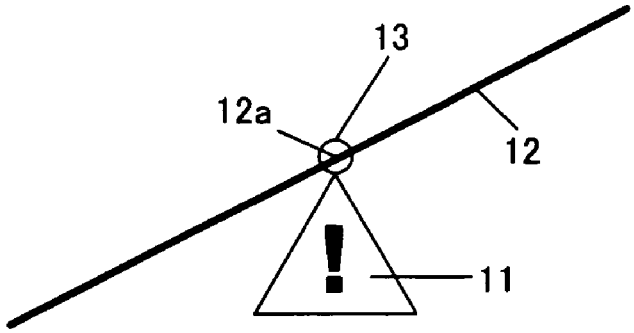
FIG. 3 is a figure showing a traffic information display method.

FIG. 3 shows an example of a display which is made by connecting together a warning sign 11 which indicates that a restriction has occurred upon the road, and the traffic event originating point 12*a* upon the road 12, with a circular mark 13. The warning sign 11 is displayed beside the road on the side of the traffic lane upon which the restriction is occurring. In this manner, by thus displaying the warning sign 11 on the side of the traffic lane upon which the restriction upon the road is occurring, it is possible for the user to recognize simply and easily the traffic lane upon which the traffic event is occurring. Furthermore, since the ground point 12*a* at which the restriction has occurred is displayed by the circular mark 13 upon the road 12 upon which the restriction has occurred, accordingly it is possible for the user to recognize simply and easily at which ground point and upon which road the traffic event has occurred, irrespective of the map scale, the degree of proximity of neighboring roads, the shape of the road and the like.

Figure 4:
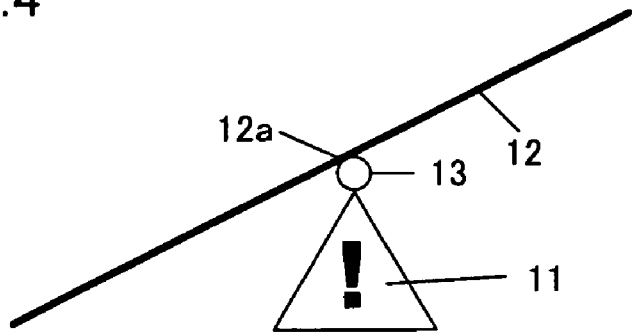
FIG. 4 is a figure showing another traffic information display method.

FIG. 4 shows an example of a display which is made by putting a circular mark 13 so that it connects together the warning sign 11 and the originating point 12*a* of the restriction, and so as to contact the road upon the side of the traffic lane upon which the restriction has occurred. According to this display method, the user is able more clearly to recognize the traffic lane upon the road at which the restriction is occurring.

Figure 5:
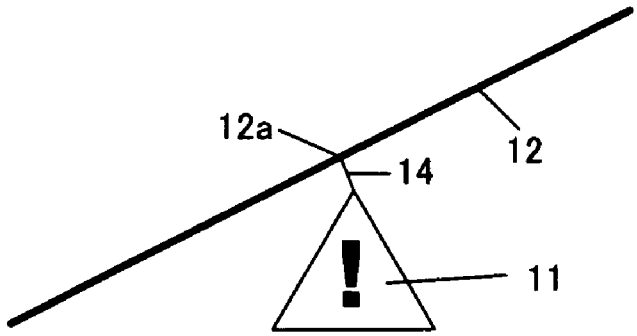
FIG. 5 is a figure showing another traffic information display method.

FIG. 5 shows an example of a display which is made by connecting the warning sign 11 and the originating point 12*a* of the restriction upon the road 12 by a straight line 14. With this display method as well, the warning sign 11 is displayed upon the side of the road of the traffic lane upon which the restriction is occurring. In this manner, it is possible for the user simply and easily to recognize the traffic lane upon which the traffic event is occurring. Furthermore, since the warning sign 11 and the originating point 12*a* of the restriction are displayed as being connected together by the straight line 14, it is possible for the user simply and easily to recognize upon which road and at which ground point the traffic event is occurring, irrespective of the map scale, the degree of proximity of neighboring roads, the shape of the road and the like.

Figure 6:
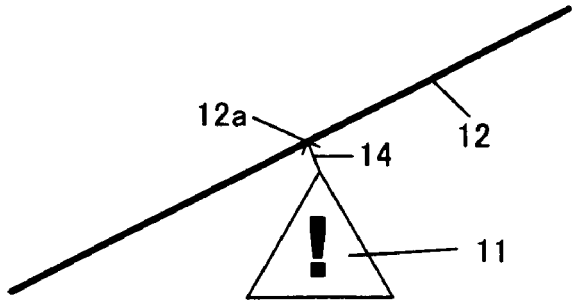
FIG. 6 is a figure showing another traffic information display method.

FIG. 6 shows an example of a display which is made by connecting the warning sign 11 and the originating point 12*a* of the restriction upon the road 12 by an arrow sign 15. With this display method as well, the warning sign 11 is displayed upon the side of the road of the traffic lane upon which the restriction is occurring. In this manner, it is possible for the user simply and easily to recognize the traffic lane upon which the traffic event is occurring. Furthermore, since the warning sign 11 and the originating point 12*a* of the restriction upon the road 12 are displayed as being connected together by the arrow sign 15, it is possible for the user simply and easily to recognize upon which road and at which ground point the traffic event is occurring, irrespective of the map scale, the degree of proximity of neighboring roads, the shape of the road and the like. It is to be noted that the direction of the arrow sign may also be from the road 12 towards the warning sign 11.

Figure 7:
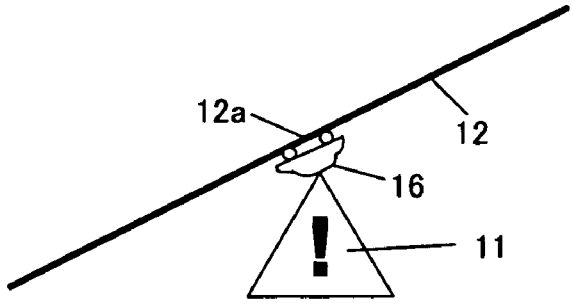
FIG. 7 is a figure showing another traffic information display method.

FIG. 7 shows an example of a display which is made by connecting the warning sign 11 and the originating point 12*a* of the restriction upon the road 12 by a drawing 16 symbolizing a vehicle. With this display method as well, the warning sign 11 is displayed upon the side of the road of the traffic lane upon which the restriction is occurring. In this manner, it is possible for the user simply and easily to recognize the traffic lane upon which the traffic event is occurring. Furthermore, since the warning sign 11 and the originating point 12*a* of the restriction are displayed as being connected together by the drawing 16, it is possible for the user simply and easily to recognize upon which road and at which ground point the traffic event is occurring, irrespective of the map scale, the degree of proximity of neighboring roads, the shape of the road and the like.

Figure 8:
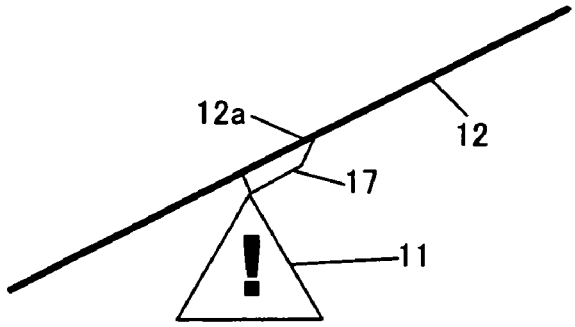
FIG. 8 is a figure showing another traffic information display method.

FIG. 8 shows an example of a display which is made by connecting the warning sign 11 and the originating point 12*a* of the restriction upon the road 12 by a drawing 17 showing the direction of progression of the vehicle. With this display method as well, the warning sign 11 is displayed upon the side of the road of the traffic lane upon which the restriction is occurring. In this manner, it is possible for the user simply and easily to recognize the traffic lane upon which the traffic event is occurring. Furthermore, since the warning sign 11 and the originating point 12*a* of the restriction upon the road 12 are displayed as being connected together by the drawing 17, it is possible for the user simply and easily to recognize upon which road, upon which traffic lane directed in which direction, and at which ground point the traffic event is occurring, irrespective of the scale at which the map is being displayed, the degree of proximity of neighboring roads, and the shape of the road and the like. Furthermore, since the drawing 17 which connects together the warning sign 11 and the originating point 12*a* of the restriction is of a design which indicates the direction of progression of the vehicle, the user is able to recognize the direction of progression of the vehicle along the traffic lane in which the traffic event is occurring in a simple and easy manner, and is able instantaneously to appreciate whether or not the traffic information relates to his vehicle.

Figure 9:
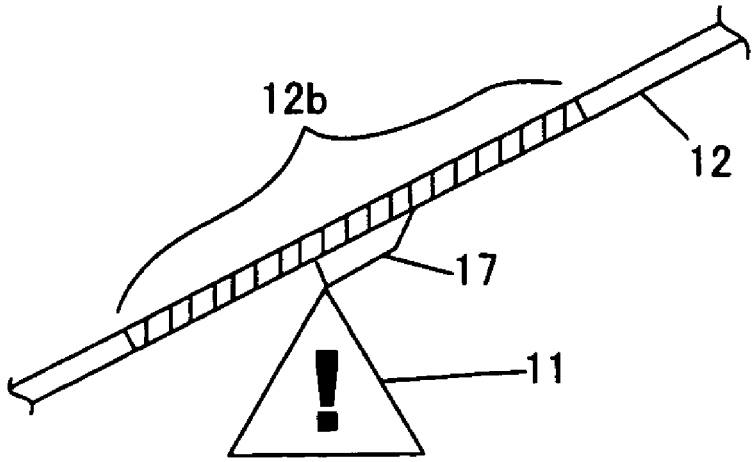
FIG. 9 is a figure showing another traffic information display method.

FIG. 9 shows an example of a display which, in a case in which the restriction upon the road is occurring over some road zone, is made by connecting the warning sign 11 which shows that a restriction is occurring upon the road, and the zone 12*b* upon the road 12 over which the restriction is occurring, by a drawing 17 which indicates the direction of progression of the vehicle. With this display method as well, the warning sign 11 is displayed upon the side of the road of the traffic lane upon which the restriction is occurring. In this manner, it is possible for the user simply and easily to recognize the traffic lane upon which the traffic event is occurring. Furthermore, since the warning sign 11 and the zone 12*b* upon the road 12 over which the restriction is occurring are displayed as being connected together by the drawing 17, it is possible for the user simply and easily to recognize upon which road, upon which traffic lane directed in which direction, and over which zone thereof the traffic event is occurring, irrespective of the map scale, the degree of proximity of neighboring roads, the shape of the road and the like. Furthermore since the drawing 17 which connects together the warning sign 11 and the zone 12*b* over which the restriction upon the road 12 is occurring, is of a design which indicates the direction of progression of the vehicle, accordingly the user is able to recognize the direction of progression of the vehicle along the traffic lane in which the traffic event is occurring in a simple and easy manner, and is able instantaneously to appreciate whether or not this traffic information relates to his vehicle.

According to the traffic information device in the preferred embodiment, along with displaying a sign which indicates the type of a traffic event upon a road, on the side of the road of the traffic lane upon which the traffic event has occurred, also it is arranged to display the traffic information by connecting together this sign and the originating point or the originating zone of the traffic event on the map with a line or a drawing. Due to this, it is possible for the user simply and easily to recognize upon which road, upon which traffic lane directed in which direction, and at which ground point or over which zone thereof the traffic event is occurring, irrespective of the map scale, the degree of proximity of neighboring roads, the shape of the road and the like.

The present invention is not limited to the preferred embodiment described above. For example, a restriction on the road has been cited as an example of a traffic event. However, the traffic event which is the object of display might be any of a traffic jam, a control imposed on traffic, an accident, road works, weather conditions or the like which exerts an influence on traffic.

Furthermore although, with the above described preferred embodiment, an example was shown in which the originating point of the traffic event or the zone corresponding to the traffic event is taken as being upon the road, the originating point or corresponding zone to the traffic event is not limited to being upon the road; for example, it might also be at a parking place, a toll plaza or the like.

Although with the above described preferred embodiment the current location of the vehicle is detected using the GPS receiver 1, this is not to be considered as being limitative of the present invention; it would also be possible to detect the current location by using autonomous navigation based on the distance traveled by the vehicle and the traveling direction.

Moreover although, in the examples of display shown in FIGS. 3 and 4, the ground point at which the traffic event originated is displayed using the circular mark 13, it would also be possible to use some symbol other than a circular mark such as a triangle, a star or the like. Furthermore although, in the display example shown in FIG. 7, the drawing 16 which connected together the traffic sign 11 and the originating point 12*a* of the traffic event is an image of a vehicle, the drawing which connects these two together is not limited to the image of a vehicle. Yet further, in the display example shown in FIG. 8 as well, the drawing which indicates the direction of progression of the vehicle is not limited to the drawing 17; for example, it would be possible to utilize a drawing such as a thick arrow sign or the like.

Figure 10:
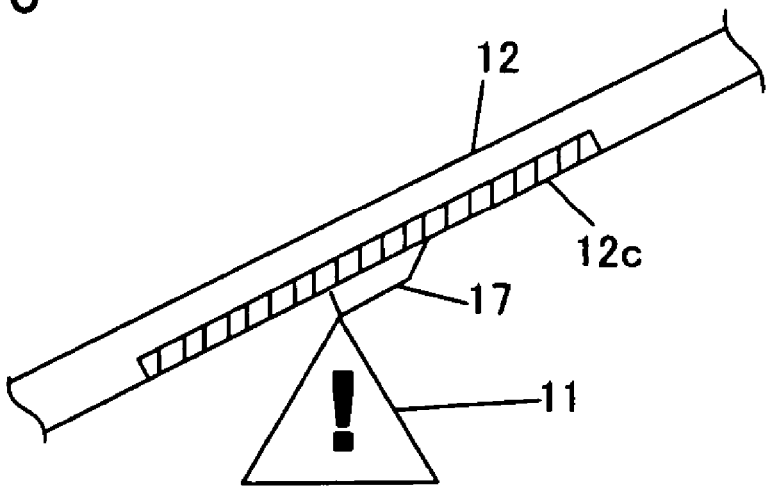
FIG. 10 is a figure showing another traffic information display method.

With the display method shown in FIG. 9, the display colors for the restriction warning sign 11, the drawing 17 and the zone 12*b* upon which the restriction on the road has occurred are made to be the same, and moreover it is possible to make this display color be a different color from the colors in which other road sections are displayed. According to this display method, it is possible for the user to recognize upon which road, in which direction, and upon which zone the traffic event is occurring, in a yet simpler and easier manner. FIG. 10 shows an example of a display in which the zone 12*c* of the lane upon which the traffic event is occurring is displayed in the same color as the restriction warning sign 11 and the drawing 17.

Although, in the above described embodiment, the application of the traffic information display device to a navigation device (on-vehicle electronic apparatus) has been explained by way of example, this is not limitative; the traffic information display device may be applied, not only to a navigation device, but also to any type of device which displays road traffic information.

The disclosures of the following priority applications are herein incorporated by reference: Japanese Patent Application 2005-90946, filed Mar. 28, 2005.

What is claimed is:

1. A traffic information display device comprising:

a monitor that displays on a map a sign which indicates a type of a traffic event at the side of a traffic lane of a road upon which the traffic event is occurring, the sign being connected to the position of the traffic event on the map through a connector displayed on the map, wherein the monitor displays the sign, a zone along the road upon which the traffic event is occurring, and the connector which connects the sign and the zone along the road in a display color, and the remaining zone along the road in a display color different from the display color for the sign, the road zone upon which the traffic event is occurring, and the connector.

2. The traffic information display device according to claim 1, wherein:

the connector is a line.

3. The traffic information display device according to claim 1, wherein:

the connector is an icon.

4. The traffic information display device according to claim 3, wherein:

the icon indicates the traveling direction of a vehicle.

5. A traffic information display method, comprising:

a display means for displaying on a map a sign which indicates a type of a traffic event at the side of a traffic lane of a road upon which the traffic event is occurring, the sign being connected to the position of the traffic event on the map through a connector displayed on the map, wherein the display means displays the sign, a zone along the road upon which the traffic event is occurring, and the connector which connects the sing and the zone along the road in a display color, and the remaining zone alone the road in a display color different from the display color for the sign, the road zone upon which the traffic event is occurring, and the connector.

6. An on-vehicle electronic apparatus comprising:

a receiver that receives traffic information, and the traffic information display device according to claim 1.

7. A traffic information display device comprising:

displaying on a map a sign which indicates a type of a traffic event at the side of a traffic lane of a road upon which the traffic event is occurring, the sign being connected to the position of the traffic event on the map through a connector displayed on the map, wherein a monitor displays the sign, a zone along the road upon which the traffic event is occurring, and the connector which connects the sign and the zone along the road in a display color, and displays the remaining zone along the road in a display color different from the display color for the sign, the road zone upon which the traffic event is occurring, and the connector.

8. An on-vehicle electronic apparatus comprising:

a receiver that receives traffic information, and the traffic information display device according to claim 2.

9. An on-vehicle electronic apparatus comprising:

a receiver that receives traffic information, and the traffic information display device according to claim 3.

10. An on-vehicle electronic apparatus comprising:

a receiver that receives traffic information, and the traffic information display device according to claim 4.

11. An on-vehicle electronic apparatus comprising:

a receiver that receives traffic information, and the traffic information display device according to claim 5.

12. A traffic information display device comprising:

a monitor that displays on a map a sign which indicates a type of a traffic event on a road upon which the traffic event is occurring, the sign being connected to the position of the traffic event on the map through a graphic symbol displayed on the map, wherein the road displayed on the map includes a first zone in which the traffic event is occurring and a second zone in which the traffic event is not occurring, the monitor displays on the map the first zone of the road in a first display color and the second zone of the road in a second display color, the first display color being different from the second display color, and the monitor displays the sign and the graphic symbol in the same display color as the display color of the first zone of the road.

13. The traffic information display device according to claim 12, wherein:

the monitor displays the sign at the side of a traffic lane upon which the traffic event is occurring.

14. An on-vehicle electronic apparatus comprising:

a receiver that receives traffic information, and the traffic information display device according to claim 12.

* * * * *